US011324309B2

(12) United States Patent
Vander Veen et al.

(10) Patent No.: US 11,324,309 B2
(45) Date of Patent: May 10, 2022

(54) FOLDING FURNITURE LATCH ASSEMBLY

(71) Applicant: Fleetwood Group, Inc., Holland, MI (US)

(72) Inventors: Mark Vander Veen, Hudsonville, MI (US); Larry Zuverink, Zeeland, MI (US)

(73) Assignee: Fleetwood Group, Inc., Holland, MI (US)

( * ) Notice: Subject to any disclaimer, the term of this patent is extended or adjusted under 35 U.S.C. 154(b) by 0 days.

(21) Appl. No.: 17/268,636

(22) PCT Filed: Aug. 14, 2019

(86) PCT No.: PCT/IB2019/056913
§ 371 (c)(1),
(2) Date: Feb. 16, 2021

(87) PCT Pub. No.: WO2020/035809
PCT Pub. Date: Feb. 20, 2020

(65) Prior Publication Data

US 2021/0186206 A1 Jun. 24, 2021

Related U.S. Application Data

(60) Provisional application No. 62/764,968, filed on Aug. 16, 2018.

(51) Int. Cl.
*A47B 3/00* (2006.01)
*A47B 3/08* (2006.01)

(52) U.S. Cl.
CPC .... *A47B 3/0815* (2013.01); *A47B 2003/0821* (2013.01); *A47B 2200/0025* (2013.01); *A47B 2200/0036* (2013.01)

(58) Field of Classification Search
CPC ..... A47B 3/0815; A47B 2003/0821; A47B 2200/0025; A47B 2200/0036;
(Continued)

(56) References Cited

U.S. PATENT DOCUMENTS 3,796,169 A * 3/1974 Bales ..... A47B 85/00 108/116
4,643,105 A * 2/1987 Baum ..... A47B 3/08 108/150
(Continued)

FOREIGN PATENT DOCUMENTS

CA 2703293 * 12/2010
DE 202006003535 * 8/2006
(Continued)

OTHER PUBLICATIONS

English translation of EP1, 159,887 (Year: 2001).*
(Continued)

*Primary Examiner* — Janet M Wilkens
(74) *Attorney, Agent, or Firm* — Gardner, Linn, Burkhart & Ondersma LLP

(57) ABSTRACT

A latch release assembly for folding furniture is provided for simultaneously releasing a plurality of latchable hinges. A rigid elongate member is connected at each end to a latch release lever of a latchable hinge. The rigid elongate member simultaneously transfers a releasing force to each release lever in order to actuate and open the connected latches to allow the latchable hinges to open and pivot. The latch release assembly may be fitted to a table top and table support frame to provide a latching hinge system for a folding table to allow a user to actuate a table from a horizontal orientation to a vertical orientation to facilitate compact and space-saving storage.

12 Claims, 6 Drawing Sheets

(58) Field of Classification Search
CPC ..... A47B 87/0207; A47B 3/08; A47B 3/0809; A47B 3/091; A47B 3/00; A47B 3/0818; A47B 7/02
USPC ..... 108/115, 91
See application file for complete search history.

(56) References Cited

U.S. PATENT DOCUMENTS 6,845,723 B2 * 1/2005 Kottman ..... A47B 3/00 108/115
8,069,795 B1 * 12/2011 Williams ..... A47B 7/02 108/115
8,091,488 B2 * 1/2012 Chirea ..... A47B 3/08 108/115
8,171,863 B2 * 5/2012 Nyenhuis ..... A47B 5/00 108/115
8,578,864 B2 * 11/2013 Nyenhuis ..... A47B 3/00 108/115
2011/0121147 A1 * 5/2011 Nyenhuis ..... A47B 3/00 248/201
2011/0290160 A1 12/2011 Williams et al.
2016/0309888 A1 10/2016 Krusin et al.
2019/0365091 A1 * 12/2019 Ruzicka ..... A47B 13/081

FOREIGN PATENT DOCUMENTS

DE 202014101396 * 4/2014
EP 1159887 * 12/2001
EP 3649891 * 5/2020
EP 3741253 * 11/2020
KR 101851556 B1 4/2018

OTHER PUBLICATIONS

International Search Report and Written Opinion of the International Searching Authority from corresponding Patent Cooperation Treaty (PCT) Application No. PCT/IB2019/056913, indicated completed on Nov. 25, 2019.

* cited by examiner

FOLDING FURNITURE LATCH ASSEMBLY

CROSS REFERENCE TO RELATED APPLICATION

The present application claims the priority benefits of International Patent Application No. PCT/IB2019/056913, filed Aug. 14, 2019, and claims priority of U.S. provisional application Ser. No. 62/764,968 filed Aug. 16, 2018, which each are hereby incorporated herein by reference in their entireties.

FIELD OF THE INVENTION

The present invention is directed to a latch assembly, in particular, a latch release assembly for a folding table with multiple latches.

BACKGROUND OF THE INVENTION

Folding and convertible furniture provides users with the ability to convert a piece of furniture for other uses or for space-saving storage. Folding and flip-nest type tables are often used in educational and commercial settings to provide desks and tables that can be stored in a space-saving configuration. Latch assemblies are often used to secure folding tables in a specific orientation or configuration. As the size of a folding table increases, additional hardware is required to allow the table to fold and be safely secured in a desired orientation. The positioning of the hardware mechanisms required to move or flip the tabletop from an operative position to the storage position can be difficult to use and expensive to manufacture.

SUMMARY OF THE INVENTION

The present invention provides a latch release assembly for simultaneously releasing two or more latches, such as for a latch assembly for an item of convertible or nesting furniture. The latch release assembly is operable to adjust or modify the orientation of at least a portion of an article of furniture, i.e. the table top of a folding or flip-nest type table. The latch release assembly provides for substantially simultaneous actuation to multiple release levers of latches of a folding table to allow the table to open from a horizontal orientation to an upright vertical orientation. The latch release assembly includes a rigid elongate member for connecting at least two latch release levers. The rigid elongate member is sufficiently rigid to transfer a force along the elongate member to actuate each of the latch release levers simultaneously.

According to one form of the invention, a latch release assembly for folding furniture includes a connection member and a plurality of latchable hinges in spaced arrangement. Each of the latchable hinges includes a first bracket or base, a second bracket or base, a hinge between the first bracket and the second bracket, a catch portion on the first bracket that is spaced apart from the hinge, and a latch release lever that is pivotably coupled the second bracket. A portion of the latch release lever, such as the distal end of the lever, is positioned and dimensioned to engage the catch portion to secure the latchable hinge in a closed position. The latch release lever is pivotable to release from the catch portion to open or release the latchable hinge. The connection member is attached to each of the latch release levers at a distal end portion of the latch release lever, such that a user may simultaneously actuate or pivot the latch release levers by applying a release force to the connection member. In one aspect, the latchable hinges are linearly spaced from each other and mechanically attached to a surface, such as an underside of a table top to provide a pivotable latch mechanism between the table top and a support frame of a pivotable, folding, or actuating table. The latchable hinges are releasable to allow the pivotable table to pivot from a horizontal or operating orientation to a vertical or storage orientation to allow multiple pivotable tables to nest with each other for space-saving storage.

In one aspect, the connection member comprises a rigid elongated member having cutouts or slots on both ends. The cutouts are configured to fixedly couple at a respective end portion of the latch release lever of each of the latchable hinges. The connection member may be formed from an elongate circular rod.

In another form of the present invention, a pivotable table assembly includes a table top, a table support frame, a pair of latchable hinges disposed in spaced arrangement on a bottom portion of the table top and an elongated connection member fixedly coupled to a latch release lever of each of the latchable hinges. The table top is pivotable about the latchable hinges to allow the table to be stored in a space-saving orientation. The latchable hinges are supported from below by the table support frame. The elongated connection member is configured to substantially simultaneously actuate each of the latchable hinges to allow the table top to fold or pivot about the latchable hinges.

Therefore, the present invention provides a simple latch release assembly for simultaneously releasing two or more latches of a folding or flip-nest type table. The latch release assembly may be configured to operate latchable hinges for various types of folding furniture, including desks, chairs, and the like. A rigid elongate connection member is fixedly attached to the latch release lever of each of multiple latchable hinges. An application of force to the connection member transfers from the connection member to the latch release levers to actuate and release the latchable hinges substantially simultaneously.

These and other objects, advantages, purposes, and features of the present invention will become more apparent upon review of the following specification in conjunction with the drawings.

DESCRIPTION OF THE PREFERRED EMBODIMENTS

Figure 1:
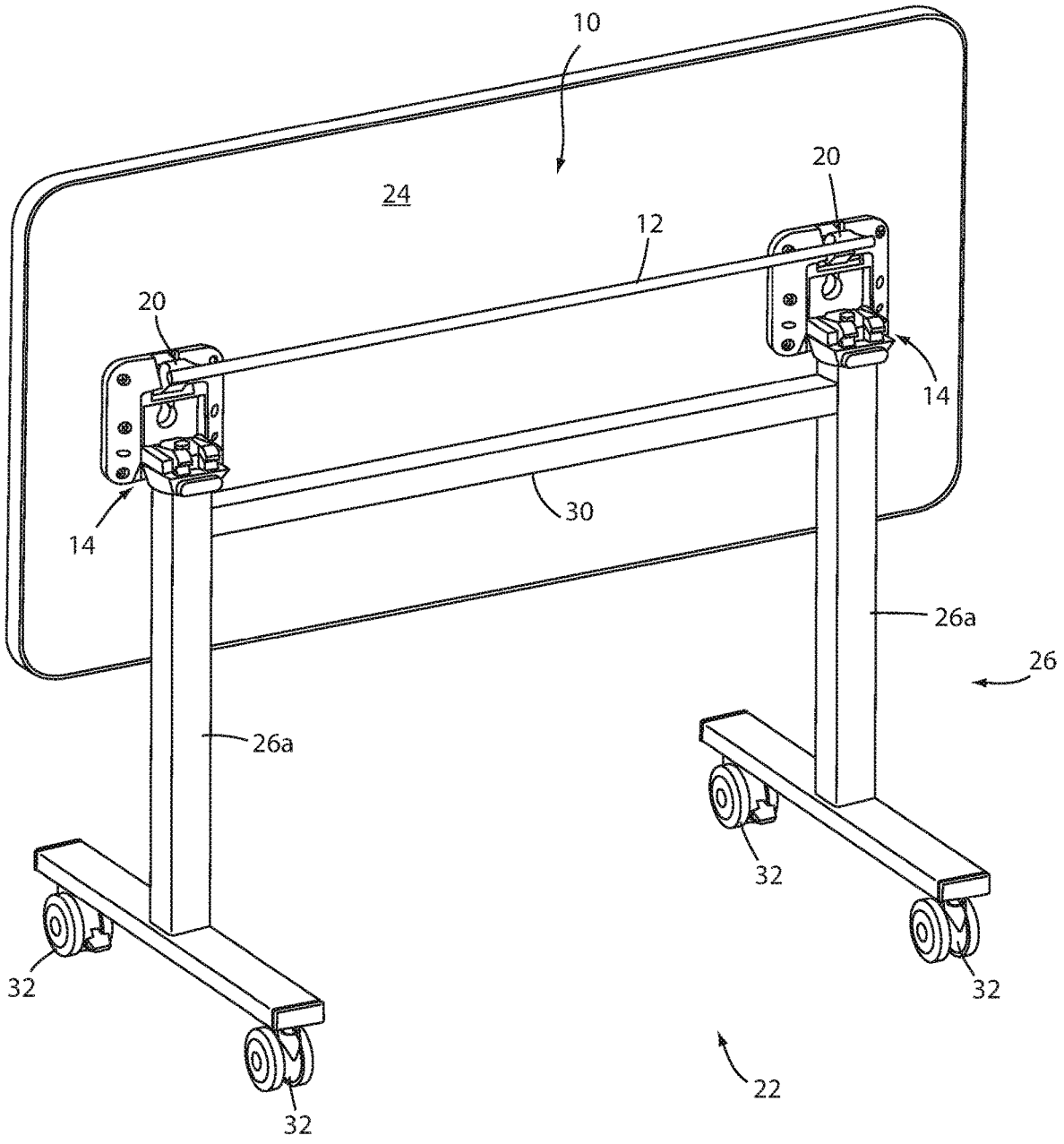
FIG. 1 is a perspective view of a folding furniture latch release assembly disposed on a pivotable table in accordance with the present invention, the table top is illustrated in a vertical or storage orientation.

Referring now to the drawings and the illustrative embodiments depicted therein, a latch assembly 10 is provided for simultaneously releasing multiple latches of article of convertible furniture, such as folding or pivotable furniture. The latch release assembly 10 includes a connection member 12, and at least two latchable hinges 14 (FIG. 1). The latch release assembly 10 may be adapted for use with convertible furniture such as a folding, pivotable, or flip-nest desk or table 22. The connection member 12 is connected to the hinges 14, and is configured to allow a user to simultaneously actuate a release lever 20 of each latchable hinge 14. The connection member 12 is sufficiently rigid and durable to withstand and transfer the force necessary to simultaneously actuate the release levers 20 in order to release the latchable hinges 14. The connection member 12 may be an elongate cylindrical rod and may include cutouts or openings 18 on each end of the connection member 12, each cutout 18 configured to engage a release lever 20 of one of the latchable hinges 14. The connection member 12 may be attached to the release levers 20 by mechanical fasteners, glue, welds, etc.

Figure 2:
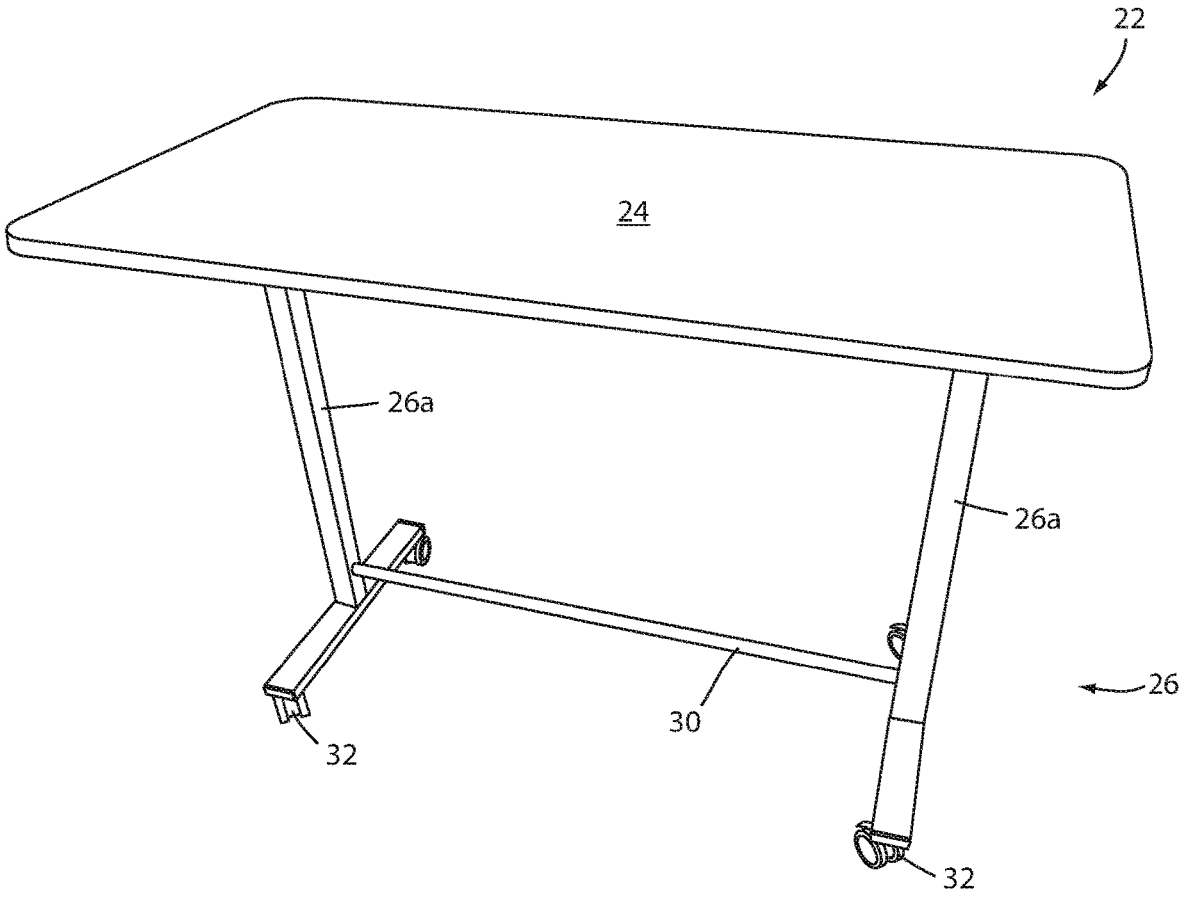
FIG. 2 is a perspective view of the pivotable table of FIG. 1 shown with the table top in a horizontal orientation.
Figure 3:
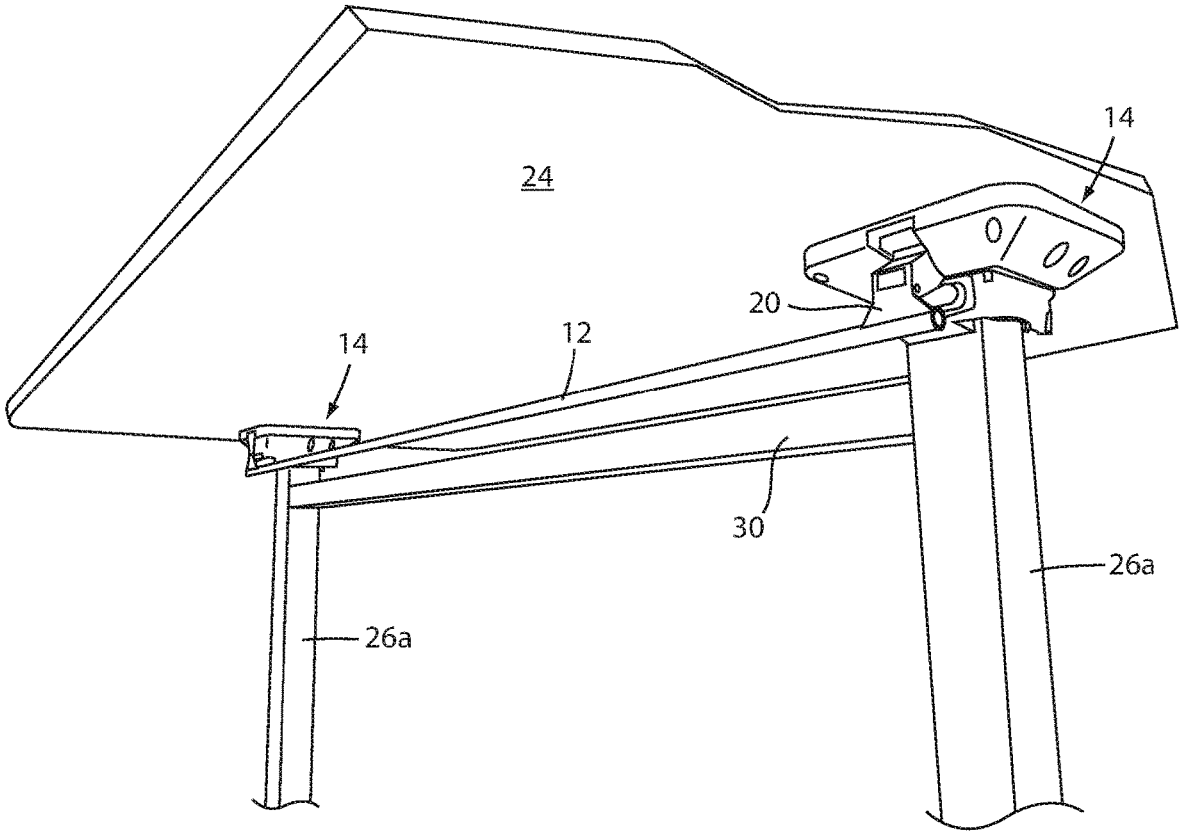
FIG. 3 is a perspective view of the latch release assembly of FIG. 1, illustrating the latch assembly mounted between the bottom surface of the table top and a table support frame.

In the illustrated embodiment, as best understood from FIGS. 1 and 3, the latch release assembly 10 is disposed on a pivotally convertible table 22, such that the latch assembly 10 is pivotally fixed between the bottom side of a table top 24 and a lower table support frame 26. Table top 24 is pivotable about the latchable hinges 14 from a horizontal orientation, shown in FIGS. 2-3, to a vertical or storage orientation, shown in FIG. 1. Latchable hinges 14 are supported from below by the lower table support frame 26. In the illustrated embodiment each latchable hinge 14 is disposed on a top portion of a tee-shaped vertical support 26*a*. A set of vertical supports 26*a* are laterally spaced to provide support for the table top 24 and are laterally supported by at least one horizontal support member 30 disposed between the vertical supports 26*a*. The table 22 is configured such that when the table top 24 is in a vertical orientation the table 22 can nest with additional tables 22 (nesting not shown). Optionally, as illustrated in FIG. 1, tee-shaped vertical supports 26*a* are supported by wheels 32 in order to easily maneuver the table 22.

Figure 4:
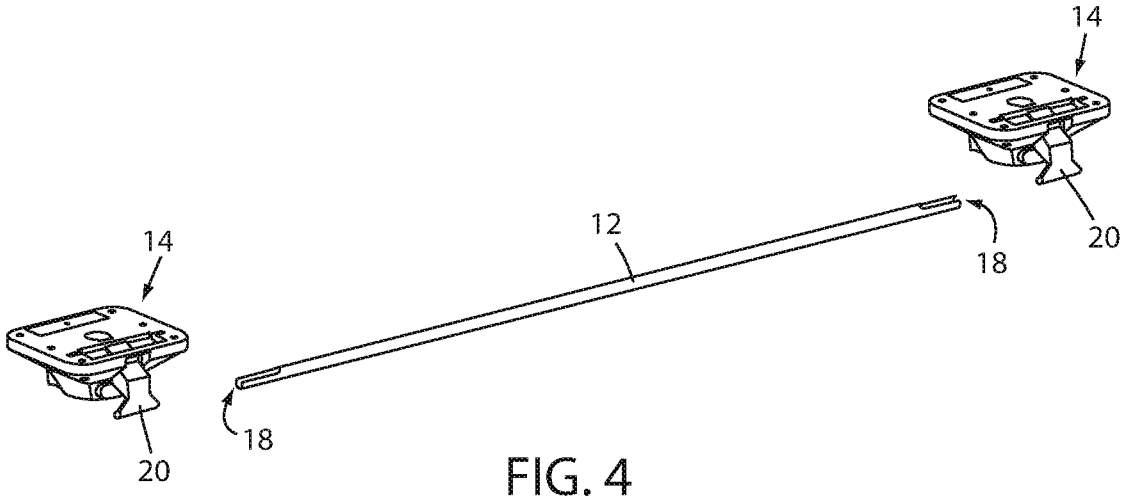
FIG. 4 is an exploded perspective view of the folding furniture latch release assembly.
Figure 5:
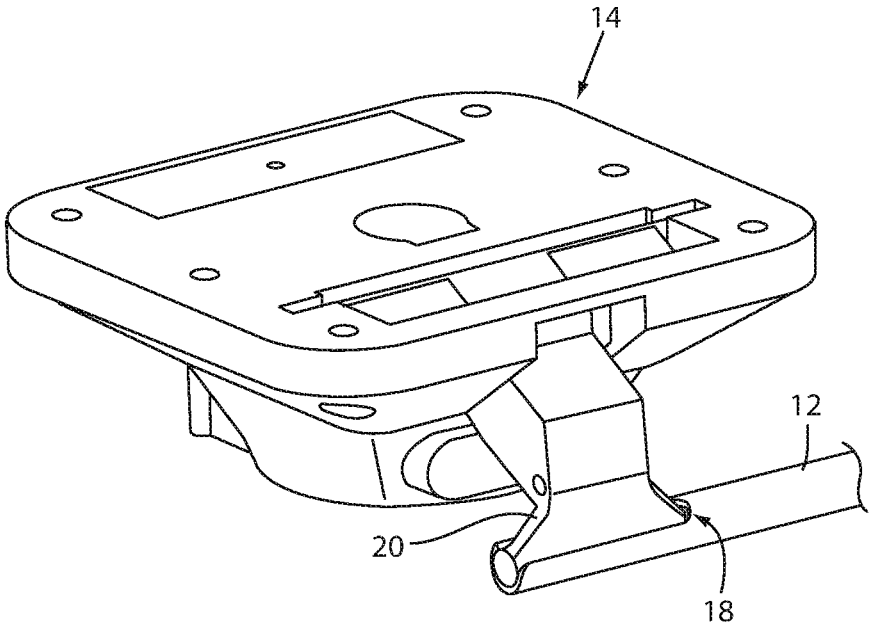
FIG. 5 is a perspective view of one of the latchable hinges of the latch release assembly of FIG. 4, shown in a latched position.
Figure 6:
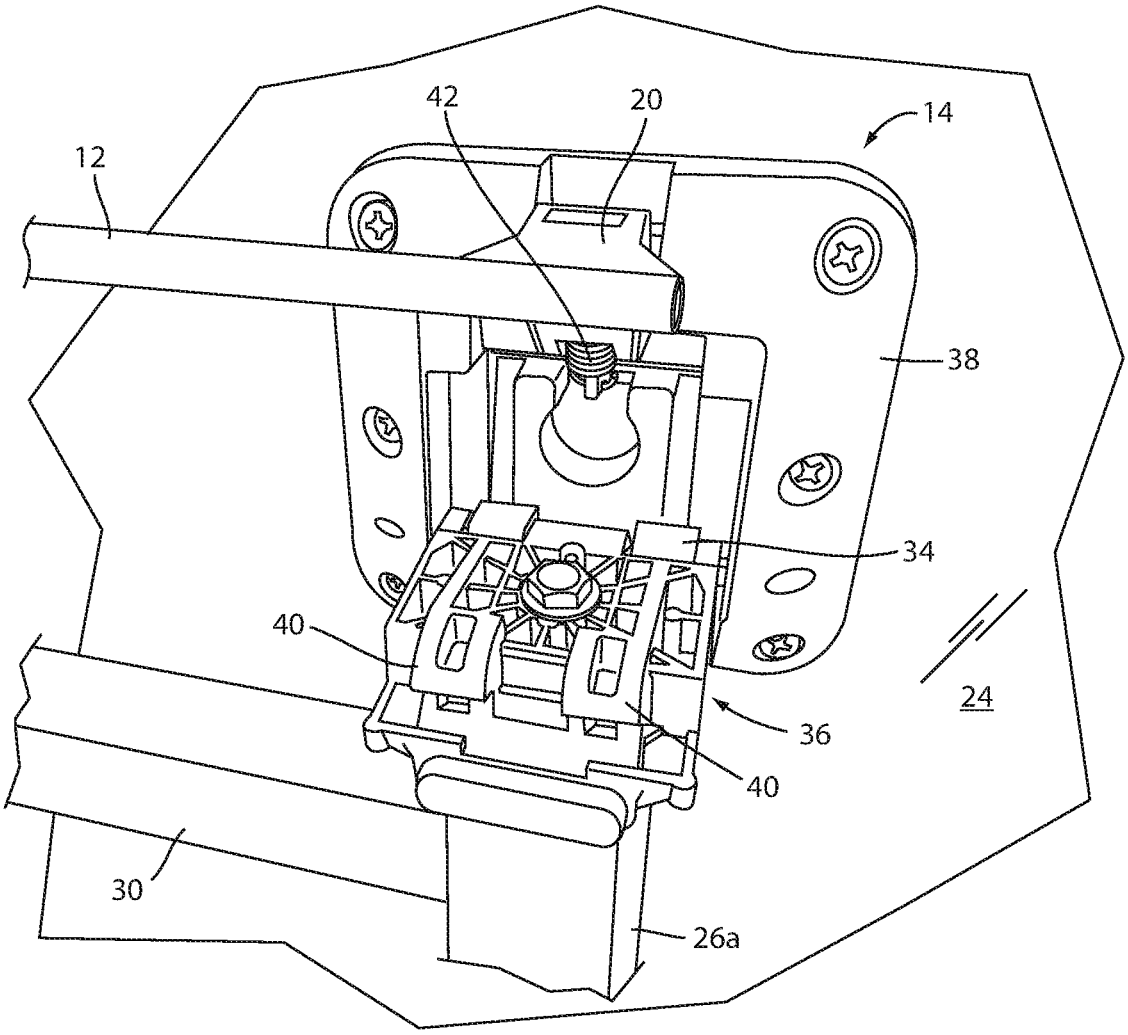
FIG. 6 is a perspective view of one of the latchable hinges of the latch release assembly of FIG. 4 shown in an unlatched position.
Figure 7:
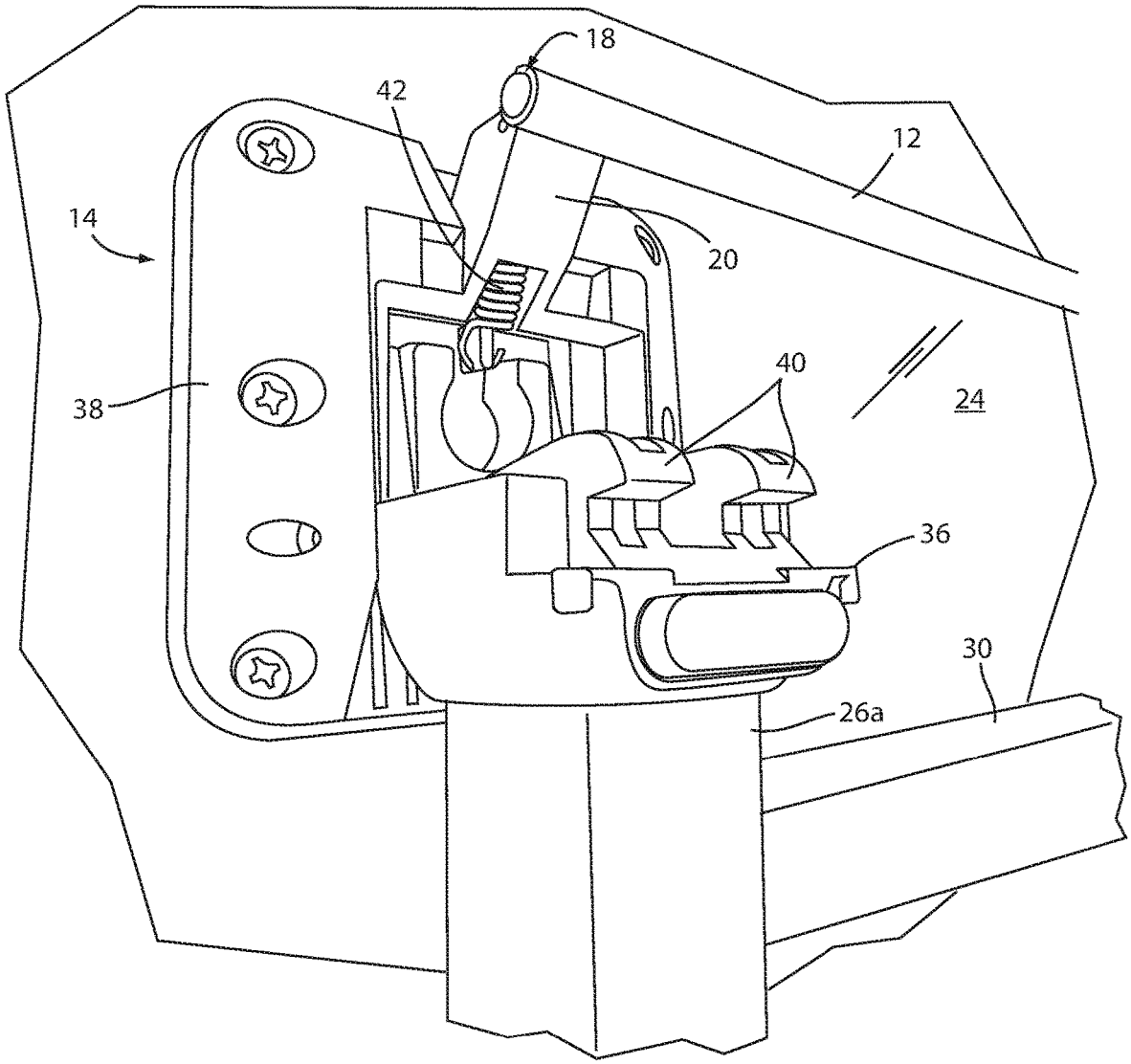
FIG. 7 is a perspective view of another latchable hinge of the latch release assembly, spaced apart from the latchable hinge of FIG. 6, shown in an unlatched position.

In the illustrated embodiments of FIGS. 1 and 3-7, the latchable hinges 14 are represented as folding table adaptors manufactured under the part number FIS 409 by Plako GmbH of Ennepetal, Germany, although other types of latchable hinges may be used. The latchable hinges 14 each include a release lever 20, a hinge 34, a bottom or lower support attachment base or hinge bracket 36, and a top or upper table attachment base or hinge bracket 38 (FIGS. 4 and 5). The hinge 34 is configured to pivotally connect the support attachment base 36 and the table attachment base 38. The support attachment base 36 is mechanically attached to the top of a respective one of the vertical supports 26*a*. The table attachment base 38 is mechanically attached to the bottom side of the table top 24 such as with screws, bolts, glue, or the like. The support attachment base 36 includes a catch portion, in the form of a set of engaging teeth 40 configured such that when the table top 24 is pivoted from the vertical to the horizontal orientation, a middle portion of the release lever 20 slides over the top of teeth 40, enters (as urged by a spring force provided by a tension spring 42) below the engaging teeth 40 after clearing the distal portion of the engaging teeth, and finally rests underneath the bottom of teeth 40 such that the release lever 20 is constrained from vertical movement when in a set latching position (FIGS. 6 and 7). When the middle portion of the release lever 20 is constrained by the engaging teeth 40, the latchable hinge 14 and table top 24 are secured in a closed or horizontal position. It will be appreciated that the catch portion of the latchable hinge 14 may be formed by a single tooth, ridge, lip, or any other suitable catch element. The release lever 20 is hingedly supported within the table attachment base 38 and is constrained by the tension spring 42, such that the release lever 20 may be rotated relative to the attachment base 38 and will be urged toward the set latching position due to tension force from the tension spring 42. In the illustrated embodiment of FIGS. 1-7, the connection member 12 is fixedly connected to the release lever 20 and configured such that the release lever 20 and the engaging teeth 40 remain operable for securing the latchable hinge 14 in a latched position, without interference between the connection member 12 and the engaging teeth 40.

Accordingly, the latch release assembly of the present invention provides a release member to simultaneously release at least two latchable hinges. The latch release assembly provides a mechanism to simply simultaneously release a latch to allow a piece of pivotable furniture to pivot in order to make storage easier. An elongate member coupled to the release levers of at least two latchable hinges transfers an application of force to the elongate member from the elongate member to the release levers of the at least two hinges to actuate the latchable hinges to unlatch substantially simultaneously and allow the furniture to pivot about the latchable hinges.

Changes and modifications in the specifically described embodiments can be carried out without departing from the principles of the present invention, which is intended to be limited only by the scope of the appended claims, as interpreted according to the principles of patent law, including the doctrine of equivalents.

The embodiments of the invention in which an exclusive property is claimed are defined as follows:

1. A latch release assembly comprising:

a plurality of latchable hinges in spaced arrangement, each of said latchable hinges comprising:

a first bracket;

a second bracket;

a hinge pivotably coupling said first bracket with said second bracket;

a catch portion disposed on said first bracket and spaced apart from said hinge; and a latch lever pivotably coupled at said second bracket, wherein a portion of said latch lever is configured to engage said catch portion to secure said first bracket and second bracket relative to one another in a closed position, and said latch lever is pivotable to release said portion of said latch lever from said catch portion to open said latchable hinge; and a connection member coupled between respective distal ends of each of said latch levers of said plurality of latchable hinges, said connection member comprising a rigid elongated member having cutouts on both ends, each of said cutouts configured to engage with and fixedly couple to a respective end portion of said latch lever of each of said latchable hinges;

wherein said connection member is configured such that a user may simultaneously pivot said latch levers of said plurality of latchable hinges by applying a release force at said connection member.

2. The latch release assembly of claim 1, wherein said plurality of latchable hinges are disposed at a bottom portion of a table top, such that said table top is pivotable about said latchable hinges.

3. The latch release assembly of claim 2, wherein said latchable hinges are supported at a table support frame.

4. The latch release assembly of claim 3, wherein said table support frame comprises a plurality of vertical support members spaced apart from one another and each vertically supporting a respective one of said latchable hinges.

5. The latch release assembly of claim 4, wherein each of said vertical support members is supported by at least two wheels.

6. The latch release assembly of claim 4, wherein said table support frame further comprises a horizontal support member coupled between said plurality of vertical support members.

7. A pivotable table comprising:

a table top;

a table support frame; and a latch assembly comprising:

a pair of latchable hinges in spaced arrangement and each disposed between a bottom portion of said table top and a portion of said table support frame such that said table top is pivotable relative to said table support frame about said latchable hinges, each of said latchable hinges having a pivotable latch release lever; and an elongated connection member comprising cutouts on both ends of said elongated connection member, each of said cutouts configured to engage with and fixedly couple to a respective distal end portion of said latch release lever of each of said latchable hinges, wherein said elongated connection member is configured to simultaneously pivot said latch release lever of each of said latchable hinges upon application of a release force at said connection member such that said latch assembly is operable to modify the orientation of at least a portion of said table top relative to said table support frame.

8. The pivotable table of claim 7, wherein each of said latchable hinges further comprises a top base coupled to said table top, a bottom base coupled to said table support frame, and a hinged connection coupling said top base with said bottom base.

9. The pivotable table of claim 8, wherein each of said latchable hinges further comprises a catch portion at said bottom base and said latch release lever is pivotably coupled at said top base, wherein a portion of said latch release lever is configured to engage said catch portion to secure said top base and bottom base relative to one another in a closed position, said latch release lever is pivotable to release said portion of said latch release lever from said catch portion to open said latchable hinge.

10. The pivotable table of claim 7, wherein said table support frame comprises a plurality of vertical support members spaced apart from one another and each vertically supporting a respective one of said latchable hinges.

11. The pivotable table of claim 10, wherein each of said plurality of vertical support members is supported by two wheels.

12. The pivotable table of claim 10, wherein said table support frame further comprises a horizontal support member coupled between said plurality of vertical support members.

* * * * *